US011702269B2

(12) United States Patent
Joseph et al.

(10) Patent No.: US 11,702,269 B2
(45) Date of Patent: Jul. 18, 2023

(54) CONTAINER FOR CONSUMABLE LIQUID HAVING CHAMBERS FOR SEPARATING INGREDIENTS AND A MIXING CHAMBER

(71) Applicants: Brian Joseph, Nashville, TN (US); Aaron Wierenga, Nashville, TN (US); Francis Shields, Nashville, TN (US)

(72) Inventors: Brian Joseph, Nashville, TN (US); Aaron Wierenga, Nashville, TN (US); Francis Shields, Nashville, TN (US)

( * ) Notice: Subject to any disclaimer, the term of this patent is extended or adjusted under 35 U.S.C. 154(b) by 0 days.

(21) Appl. No.: 16/556,209

(22) Filed: Aug. 29, 2019

(65) Prior Publication Data

US 2020/0385193 A1 Dec. 10, 2020

Related U.S. Application Data

(60) Provisional application No. 62/724,323, filed on Aug. 29, 2018.

(51) Int. Cl.
*B65D 81/32* (2006.01)
*B65D 41/04* (2006.01)

(52) U.S. Cl.
CPC ..... *B65D 81/3288* (2013.01); *B65D 41/04* (2013.01); *B65D 81/3266* (2013.01)

(58) Field of Classification Search
CPC ..... B65D 81/3288; B65D 41/04; B65D 81/3266; B65D 25/087; A61J 1/2093
USPC ..... 222/145.5, 145.1, 129; 206/219, 221
See application file for complete search history.

(56) References Cited

U.S. PATENT DOCUMENTS 6,752,264 B2 * 6/2004 Versluys ..... B65D 75/5883 206/219
2007/0253761 A1 * 11/2007 May ..... B29C 45/0081 401/133
2013/0306498 A1 * 11/2013 Azani ..... B65D 35/22 206/219
2015/0101942 A1 * 4/2015 Wu ..... B65D 51/2864 206/219
2016/0270600 A1 9/2016 Pappas et al.

* cited by examiner

*Primary Examiner* — Vishal Pancholi
*Assistant Examiner* — Robert K Nichols, II
(74) *Attorney, Agent, or Firm* — Condo Roccia Koptiw LLP

(57) ABSTRACT

A Container For Consumable Liquids Having Chambers For Separating Ingredients And A Mixing Chamber, which is a unitary modular fluid container with a multitude of components, whereby, the segmented contents, such as alcohol, may be combined through an apparatus of mixing.

15 Claims, 9 Drawing Sheets

Gas chromatogram of the volatile compounds in a fermented agave juice using headspace injection system: (1) Acetaldehyde, (2) ethyl acetate, (3) methanol, (4) ethanol, (5) 1-propanol, (6) Isobutanol, (7) ethyl valerate, (8) 1-butanol, (9) amyl alcohols, (10) ethyl caproate, (11) ethyl lactate, (12) 2-furfuraldehyde, (13) ethyl caprate. (Arellano, Gschaedler, and Alcazar 2012)

CONTAINER FOR CONSUMABLE LIQUID HAVING CHAMBERS FOR SEPARATING INGREDIENTS AND A MIXING CHAMBER

FIELD OF THE INVENTION

The present invention relates generally to beverage containers, and more specifically to an apparatus for dispensing and mixing of multi-component liquids.

BACKGROUND

Currently available pre mixed multigradient drinks fail to give the consumer the qualities that freshly made drinks deliver. Many existing pre-mixed drinks suffer from chemical instability and as a result do not last long. In order to keep them stable, many mixed drinks, require preservatives or utilize undesirable ingredients such as sugar and/or can affect flavor in an undesirable way. A device that can contain the ingredients and keep them separate until the consumer is ready to mix and consume would provide a fresh and improved flavor and aroma as well as the portability and ergonomic features of a small container.

Multi-component fluid containers that provide mixing at point of use have multiple challenges associated. They require ease of manufacture for production economies of scale; an opening sufficient to allow each of the individual components to be dispensed into each separately allocated chamber via a filling mechanism; a uniform single-plane sealing surface for an ideal closure to inhibit foreign material or microbial contamination and permit dispensing; protection from degradation materials such as oxygen or light; an area for sufficient mixing of separately stored flowable materials, fluids, or accompaniments; and an ergonomic exterior shape adapted for human mobility during storage and interaction in the human hand during consumption. Additionally, plastic multi-chamber packaging has the benefit of recyclability and reduced susceptibility to tariff and trade disputes when compared to aluminum.

The prior art contains multi-chamber beverage containers. For example, US application 20160270600A1 includes a variable opening multi-chamber beverage container with a top mounted mixing chamber to allow dispensing of the mixed beverage, and mixing when the beverage is inverted.

SUMMARY OF THE INVENTION

Disclosed below is, inter alia, a combined flavor addition mixing system and beverage quality, aroma, and flavor protection device, and corresponding method, for the maintenance of individual component ingredients over the expected shelf life of a ready to drink beverage. In general, the embodiments disclosed herein provide the consumer the satisfaction of seeing the component ingredients, which have been maintained in separate, isolated chambers, mix together upon opening of the container. This "consumer participation" in the mixing of the component ingredients provides differentiation in the beverage product market, enhancing the perceived value of a ready to drink through participation in the assembly and preparation of a drink product. The description herein of advantages of the present embodiments and/or the disadvantages of the prior art are not intended to limit the scope of the invention, nor to disclaim any structure or function of the inventive subject matter disclosed below.

A sealed multi chamber container for flowable materials provides a means for discharging the material contained within each of the chambers and a means for access to the materials contained in the chambers. The container ideally provides both features concurrently, or may alternatively provide access after discharge. The individual chambers of the container may be assembled via various combinatory means to promote interchange of chamber designs, discharge locations, wall thicknesses, shapes, sizes, flowable fill materials etc. The discharge of the materials in the chambers may permit mixing between two or more of the chambers. Alternatively, the container may be a sub-container or an insert for a secondary containment vessel, such as a beverage container that houses the insert, which provides a mixing/admixing region or container. The insert container may for example be a neck fitting inserted into the secondary containment vessel or outer container. The secondary containment vessel retains the mixed ingredients in an additional containment region and may allow for dispensing the mixed ingredients via a pour spout or other discharge means.

The container provides for a beverage which keeps ingredients separated and prevents or inhibits gas or microbial permeability, keeping the product commercially food safe, and generally improved, until the user is ready to drink. Dividing walls or partitions inside the container form at least two ingredient or constituent chambers, also referred to as storage chambers, where different ingredients are stored. The container may have a separate mixing chamber, where the ingredients housed in the constituent chambers will be combined upon actuation of the mixing means, or may allow the contained ingredients to mix in the storage chambers themselves. The mixing chamber and ingredient chambers are kept separate by a separating member or membrane, which preferably is frangible. When the user is ready to dispense the drink, a release mechanism of the mixing means removes the separation between the mixing chamber and the ingredient chambers, allowing the ingredients to combine into a completed ready-to-drink beverage. If a secondary containment vessel is utilized as the mixing chamber it may provide a shroud around interior ingredient chambers, adding additional protection, enhancing shelf presence, and providing ergonomic benefits, as will be understood by persons familiar with conventional beverage packaging technology.

The complete ready to drink product aims to utilize individual component beverage package separation technology by keeping the constituents separate until near the time for drinking. Therefore, the beverage may be supplied with minimal product formulation shelf life stabilization technology known in the art to closely approximate fresh beverage products that are convenient, portable, ergonomic, long lasting, and perceived by the consumer to most closely approximate a freshly made beverage, while offering visibility to the mixing process. Current beverage stabilization technology, including microwave, thermal processing, pressure processing, UHT, pasteurization, radiation, cell lysis technologies, and refrigeration, may be employed, and may be diminished by employing the technology disclosed herein.

In some embodiments, the ingredient chambers are located inside or parallel to the mixing chamber. In some embodiments the ingredient chambers are located above the mixing chamber, such as in the neck of a bottle or underneath the closure, to promote a gravity drop into the mixing chamber when the separation member is ruptured, such as upon opening of the closure. In some embodiments the ingredient chambers or the mixing chamber may be clear or opaque to facilitate visibility of the unmixed or mixed components.

In one embodiment, a multi-chamber container for beverages is contemplated with individual separated ingredient chambers that may be pre-formed, or a group of ingredient chambers that may be pre-formed, and subsequently inserted in an extrusion blow mold to allow an extruded parison to enclose or surround the chambers, and form an exterior package shape. In one embodiment, the internal preformed or groups of pre-formed ingredient chambers are filled with the ingredients prior to forming the exterior package shape.

Alternatively, a multitude of internal parisons forming the internal chambers may be co-extruded inside the outer parison that forms the exterior package layer. The internal chambers may be filled during the co-extrusion process. Trimming excess material at the neck and base of the container may be accomplished by means known to those of skill in the art of forming a finished beverage container with chambers inside the exterior shaped package. In some embodiments, the exterior package shape may form the mixing chamber. In some embodiments the neck of the container may contain flow channels to connect the ingredient chambers to the mixing chamber. In an alternative embodiment the mixing chamber may be juxtaposed or parallel to the ingredient chambers Materials for the production of packages would include those typical for selection in food and beverages, and more particularly would allow for interaction with all of the liquid beverage components, allowing for example interaction with acids, bases, and alcohols, while preventing degradation of beverage contents. Further, it may be desirable to provide translucent or opaque layers or windows in certain sections of the package to allow visibility to the components. Alternatively, an overwrap to minimize or protect the product from exposure to light may be desirable. Non limiting examples of these materials are known to those of skill in the art, and may include HDPE, PET, EVOH, PET, and the like, and new or future food and beverage contact safe materials.

As an example of degradation of ready-to-drink (RTD) drinks when mixed, results showed that citral and methylheptenone contribute to the enhanced feelings of natural juice and freshness. Citral is an important flavor component among citrus oils. But it is highly unstable in beverages and converts into off-flavors such as p-cymene (gasoline-like), p-methylacetophenone (bitter-almond-like) and p-cresol (phenolic). The deterioration of citral proceeds during the storage of products, resulting in an undesirable alteration of the product flavor profile. In Citral off-flavor formation, off-flavors are generated through oxidation-triggered deterioration.

On the other hand, methylheptenone has a green aroma with high flavor stabilizing properties, and, combined with citral, this component is considered to maintain a feeling of freshness.

Therefore, polyphenol-containing materials can be combined with the citrus juice component in the individual chamber, and may be combined with some plant extracts, such as olive fruit extract, which has been found to have a considerable inhibitory effect on off-flavor generation.

Furthermore, identification of the optimal product pH to minimize the acid-induced circularization of citral may be beneficial.

Through antioxidant usage and pH optimization with the individual juice component, it is possible to develop a product that maintains the fresh feeling of natural juice even after long-term storage when separated from other ingredients.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future. Furthermore, the use of plurals can also refer to the singular, including without limitation when a term refers to one or more of a particular item; likewise, the use of a singular term can also include the plural, unless the context dictates otherwise.

The presence of broadening words and phrases such as "one or more," "at least," "but not limited to" or other like phrases in some instances shall not be read to mean that the narrower case is intended or required in instances where such broadening phrases may be absent. Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

There has thus been outlined, rather broadly, the more important features of the disclosure in order that the detailed description thereof may be better understood, and in order that the present contribution to the art may be better appreciated. There are additional features of the disclosure that will be described hereinafter and which will also form the subject matter of the claims appended hereto. The features listed herein and other features, aspects and advantages of the present disclosure will become better understood with reference to the following description and appended claims.

BRIEF DESCRIPTION OF THE FIGURES

The accompanying drawings, which are incorporated in and form a part of this specification, illustrate embodiments of the disclosure and together with the description, serve to explain the principles of this invention.

DETAILED DESCRIPTION OF THE INVENTION

Figure 1:
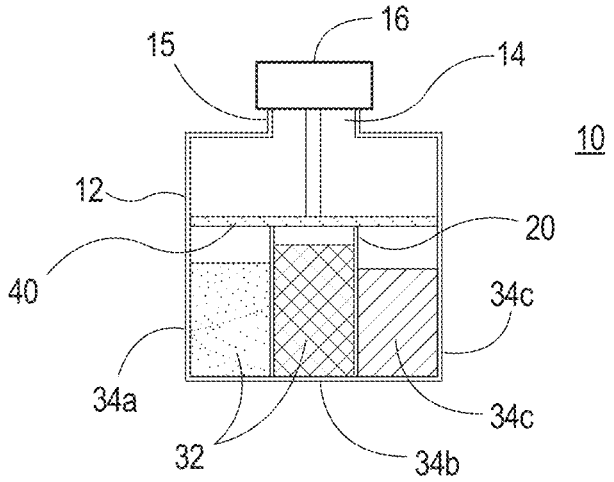
FIG. 1 is a front schematic, sectional illustration of one embodiment of the full assembly of the liquid housing that incorporates all parts of the invention.
Figure 1A:
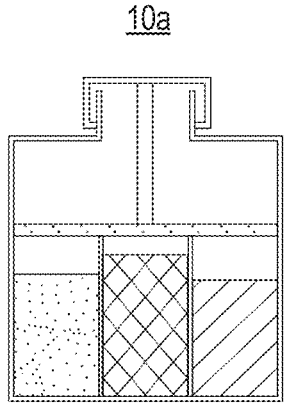
FIG. 1*a*-1*d* is a sequence of steps depicting the order of operation for the embodiment as shown in FIG. 1.
Figure 1B:
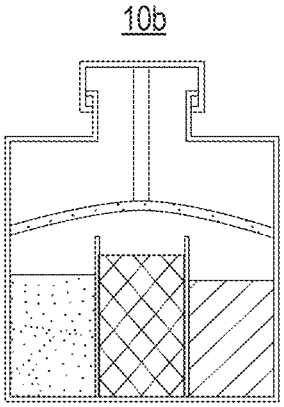
Figure 1C:
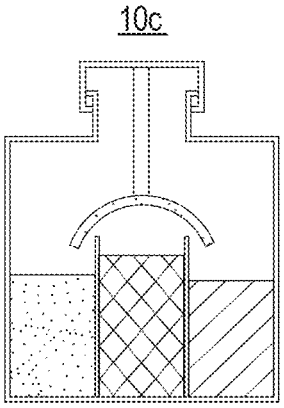
Figure 1D:
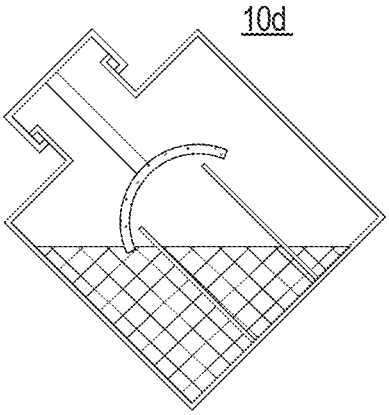

Many aspects of the invention can be better understood with the references made to the drawings below. The components in the drawings are not necessarily drawn to scale. Instead, emphasis is placed upon clearly illustrating the components of the present invention. Moreover, like reference numerals designate corresponding parts through the several views in the drawings.

As shown in FIG. 1, a package device 10 has a liquid housing, such as a beverage container 12, which houses other ingredients and parts. This unitary container 12 can be made out of plastic, glass, metal, or any other material suitable for the storage and dispensation of liquids. The shape can be similar to a liquor flask, which has perceptual advantages as well as functional ones (easy to fit in a pocket or bag, easy to array efficiently on a shelf). Preferably, the sidewalls of container 12 are clear.

The container 12 has an opening 14 that allows the mixed ingredients to be dispensed. The opening may be a shape that agitates or aerates ingredients. The opening 14 may allow air into the liquid housing 12 as liquid is being dispensed. The opening 14 may create a noise or vibration during dispensation to give feedback to the user indicating that liquid is in the process of dispensation as well as indication that liquid has stopped dispensation. The opening 14 may create a surface comfortable for contacting the consumers lips accommodating for a variety of mouth shapes. The opening 14 may create a surface that allows contents/liquid to be poured in a controlled shape (with a desirable shape) or may influence the flow and consistency of the contents as they are dispensed. The liquid can be an alcohol ingredient, such as one having an alcohol by volume of greater than 15%.

The device 10 has a closure, such as a cap 16 that is primarily used as a common recloseable container cap. The cap 16 may be used to close or open the liquid housing by covering or uncovering the opening 14. The cap may attach to the rim 15 by conventional, mutual threads (not shown in the figures), an expandable ring or bead, a crimped metal cap, or a gasket that corresponds with the rim 15. The cap 16 may have a friction fit. The cap 16 may include a tether 88 (FIG. 22) that creates an additional connection to the liquid housing that is flexible. The cap 16 may be made of a variety of materials such as plastic, glass, metal, or any other material suitable for sealment, pressure change, tamper resistance, and the like. The cap 16 may contain a chamber that may include liquid, gas, or solid ingredients.

The device 12 defines an internal mixing chamber 20 which allows combination of ingredients stored in ingredient chambers. This chamber 20 can be made out of plastic, glass, metal, or any other material suitable for the storage and dispensation of liquids and consistent with usage with the material of container 12. This chamber 20 may be at the top, bottom, left, right, back, front, interior, or interior of the housing 12. The mixing chamber may be empty, but may also contain a gas (such as nitrogen or CO2), liquid, or solid. The mixing chamber may contain materials that enhance the flavor, consistency, or aromatic qualities of the product. The mixing chamber may be removable from the rest of the liquid housing, or the mixing chamber may be formed by a portion of the housing 12. The opening of the mixing chamber may be proportional in size to the capacity of said chamber 12, or be sized to achieve specific mixing properties.

The device 10 has one or more partitions or dividing walls 30 which separate the housing into chambers 32 for housing the constituents or ingredients and keeping the constituents separate from one another. The dividing wall(s) 30 may be an integral part of the liquid housing or may be removable parts. They can be made out of plastic, glass, metal, or any other material suitable for the storage, separation, and dispensation of liquids.

The device has a liquid chamber which contains the plurality of the ingredient chambers 32.

Figure 5:
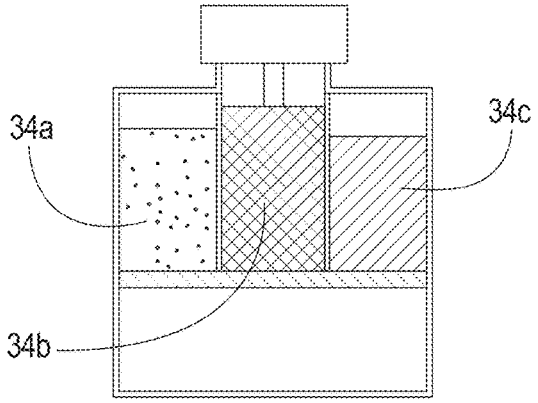
FIG. 5 is a front sectional view of one embodiment of a partial assembly of the liquid housing that incorporates the cap, opening, release mechanism, separating member, mixing chamber and liquid chambers.
Figure 6:
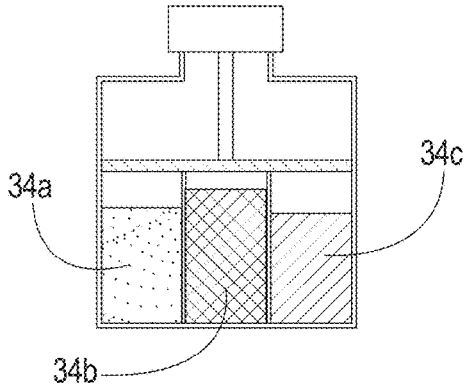
FIG. 6 is a front sectional view of one embodiment of a partial assembly of the liquid housing that incorporates the cap, opening, release mechanism, separating member, mixing chamber and liquid chambers.
Figure 7:
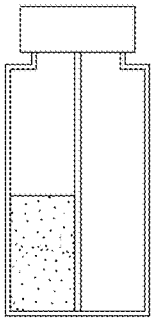
FIG. 7 is a side sectional view of one embodiment of a partial assembly of the liquid housing that incorporates the cap, opening, mixing chamber and liquid chambers.
Figure 8:
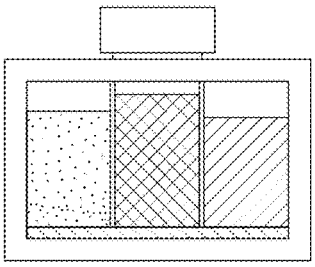
FIG. 8 is a front sectional view of one embodiment of a partial assembly of the liquid housing that incorporates the cap, opening, separating member, mixing chamber and liquid chambers.
Figure 9:
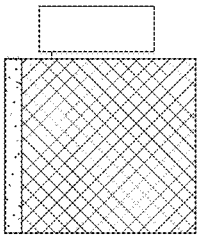
FIG. 9 is a front view of one embodiment of a partial assembly of the liquid housing that incorporates the cap, opening, and liquid chambers.

The device 10 has a first ingredient chamber 34*a* which can contain one or more ingredients, or remain empty. This chamber can be made out of plastic, glass, metal, or any other material suitable for the storage and dispensation of liquids. The ingredients can be solid, liquid, or gas. This chamber may be at the top, as shown in FIG. 5, bottom as shown in FIG. 6, left, right, back, as shown in FIG. 7, front, as shown in FIG. 8, or interior of the mixing chamber 20, as shown in FIG. 9. The first ingredient chamber may contain materials that enhance the flavor, consistency, or aromatic qualities of the product. The first ingredient chamber may be removable from the rest of the liquid housing. The opening of the first ingredient chamber may be proportional in size to the capacity of said chamber, or be sized to achieve specific mixing properties.

The device has a second ingredient chamber 34*b* which can contain one or more ingredients, or remain empty. This chamber can be made out of plastic, glass, metal, or any other material suitable for the storage and dispensation of liquids. The ingredients can be solid, liquid, or gas. This chamber may be at the top, as shown in FIG. 5, bottom as shown in FIG. 6, left, right, back, as shown in FIG. 7, front, as shown in FIG. 8, or interior of the mixing chamber 20, as shown in FIG. 9. The second ingredient chamber may contain materials that enhance the flavor, consistency, or aromatic qualities of the product. The second ingredient chamber may be removable from the rest of the liquid housing. The opening of the second ingredient chamber may be proportional in size to the capacity of said chamber, or be sized to achieve specific mixing properties.

The device has a third ingredient chamber 34*c* which can contain one or more ingredients, or remain empty. This chamber can be made out of plastic, glass, metal, or any other material suitable for the storage and dispensation of liquids. The ingredients can be solid, liquid, or gas. This chamber may be at the top, as shown in FIG. 5, bottom as shown in FIG. 6, left, right, back, as shown in FIG. 7, front, as shown in FIG. 8, or interior of the mixing chamber 20, as shown in FIG. 9. The third ingredient chamber may contain materials that enhance the flavor, consistency, or aromatic qualities of the product. The third ingredient chamber may be removable from the rest of the liquid housing. The opening of the third ingredient chamber may be proportional in size to the capacity of said chamber, or be sized to achieve specific mixing properties.

The device has a separating member or membrane 40 which keeps the mixing chambers 34*a*, 34*b*, and 34*c* separated from other ingredient chambers. Membrane 40 can be a plunger, film, seal, or other means. The separating member 40 may be made out of plastic, glass, metal, or any other material suitable for the storage and dispensation of liquids. The separating member may be made of a dissolvable material. Preferably, membrane 40 is a frangible cover that encloses each one of the ingredient chambers. For example, as illustrated in FIGS. 1 and 1*a* through 1*d*, membrane 40 in its sealed, at rest state is sealed over each chamber 34*a*, 34*b*, and 34*c* and, as illustrated in the embodiment, sealed about an interior surface of the sidewall of container 12, such as by ultrasonic welding when container 12 and membrane 40 are suitable polymers. Alternatively, the membrane may be flexible and merely deform to unseal the chambers. The term "breach" is used to either break a frangible seal or deform a flexible seal to enable the mixing of the constituents.

A release mechanism, such as a link 42 extends between and is attached to both the underside of closure 16 to membrane 40 at opposing ends of link 42. Actuation of the cap 16 by unscrewing cap 16 from container 12 or lifting cap 16 up relative to container 12 moves the release mechanism 42, which in turns moves the separating member 40 upwardly. The release mechanism 42 may be made out of a rigid, frangible material or flexible material suitable releasing or breaking the seal about the ingredient chambers and the mixing chamber. In this regard, membrane may be formed with partial perforations or a score to control the location of point of breaking of the membrane 40 upon actuation of the cap 16, and the force applied by or displacement created by mechanism 42

Figure 2:
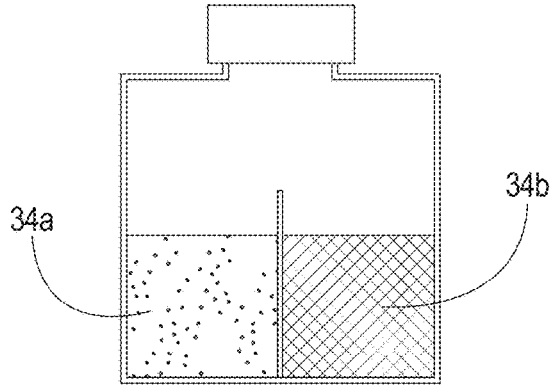
FIG. 2 is a front sectional view of one embodiment of a partial assembly of the liquid housing that incorporates the cap, opening, mixing chamber and liquid chambers.
Figure 3:
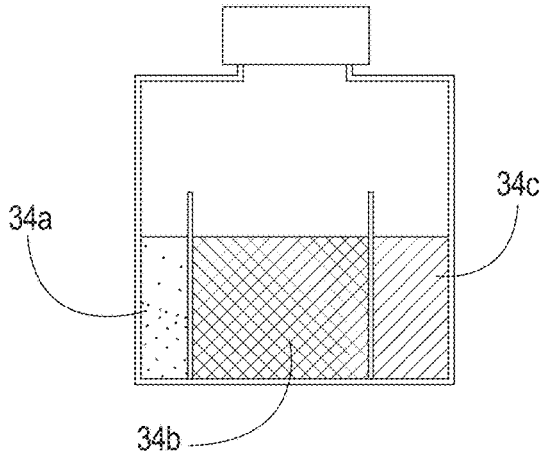
FIG. 3 is a front sectional view of one embodiment of a partial assembly of the liquid housing that incorporates the cap, opening, mixing chamber and liquid chambers.
Figure 4:
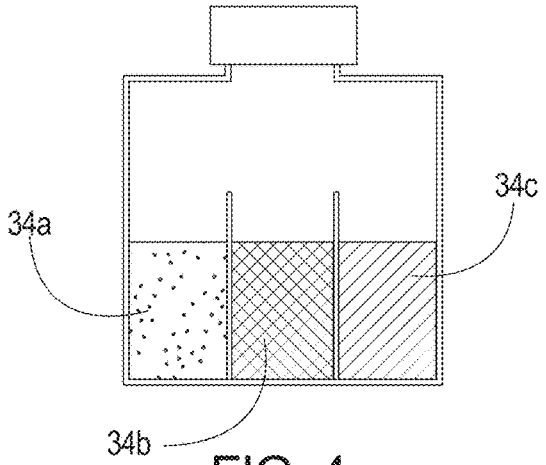
FIG. 4 is a front sectional view of one embodiment of a partial assembly of the liquid housing that incorporates the cap, opening, mixing chamber and liquid chambers.

In one embodiment, as shown in FIG. 2 the liquid housing has multiple ingredient chambers 34*a* and 34, which partitions forming the chambers divide the container radially. In one embodiment, as shown in FIG. 3, the liquid housing 12 has multiple ingredient chambers of unequal size. In one embodiment, as shown in FIG. 4, the liquid housing 12 has multiple ingredient chambers of equal size. In one embodiment, as shown in FIG. 5, the liquid chamber 32 is located above the mixing chamber 20. In one embodiment, as shown in FIG. 6, the liquid chamber 32 is located below the mixing chamber 20. In one embodiment, as shown in FIG. 7, the liquid chamber 32 is located in front of the mixing chamber 20. Alternatively, the locations of the front and back may be reverse such that liquid chamber 32 is located in back of the mixing chamber 20.

Figure 10:
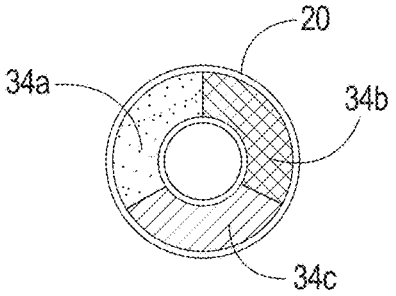
FIG. 10 is a top view of the embodiment as shown in FIG. 9.
Figure 11:
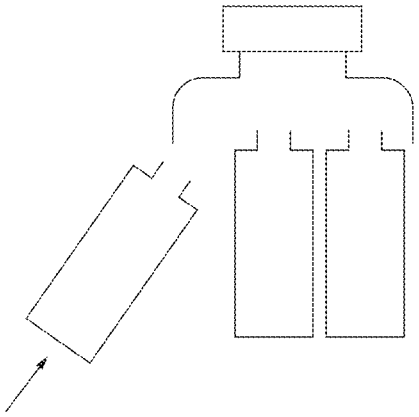
FIG. 11 is a front sectional view of one embodiment of a partial assembly of the liquid housing that incorporates the cap, opening, mixing chamber, liquid chambers, with one ingredient chamber being removed.
Figure 12:
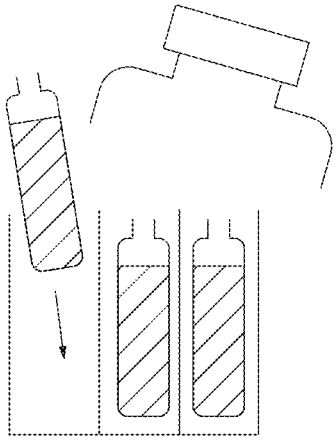
FIG. 12 is a front sectional view of one embodiment of a partial assembly of the liquid housing that incorporates the cap, opening, mixing chamber, liquid chambers, with one ingredient membrane being removed.

In one embodiment, as shown in FIG. 9 and FIG. 10, the liquid chamber 32 is located surrounding the mixing chamber 20. This may be desirable from an appearance, manufacturing, or functional standpoint. In one embodiment, as shown in FIGS. 11 and 12, is an alternative detail depicting ingredients in membranes or ampules being inserted into chambers. This may be desirable in order to simplify manufacturing.

Figure 13:
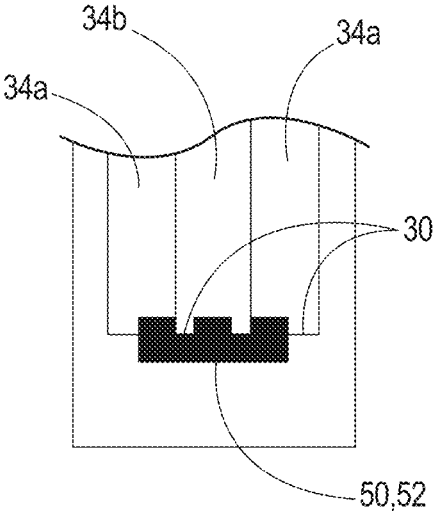
FIG. 13 is a detailed view of one embodiment of a partial assembly of the liquid housing that incorporates liquid chambers, and a plug/agitator in a plugged state.
Figure 14:
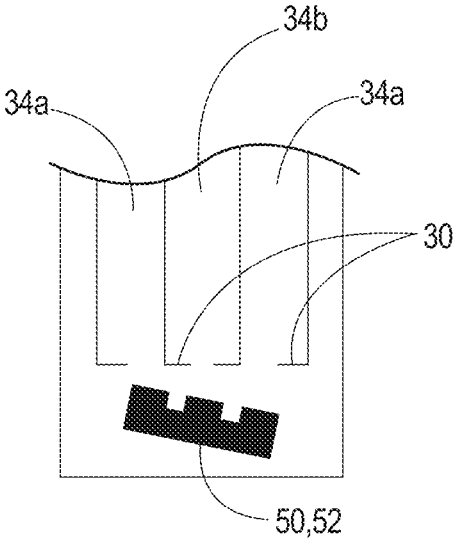
FIG. 14 is a detailed view of the plug/agitator in a released state from the state as shown in FIG. 13.

In one embodiment, as shown in FIGS. 13 and 14, is an alternative detail depicting a plug 50 or an agitator 52 inside a chamber. Plug 50 may be releasable upon actuation of closure 16, such as by release of either vacuum or positive pressure holding plug 50 against partitions 30. Agitator 52 may be configured to mix or create local turbulence to agitate the liquid. This may be desirable to assist in the mixing of ingredients, but may also be purely to improve the customer experience (such as the sound of the agitator, the positive feeling of customer engagement in the mixing process).

Figure 15:
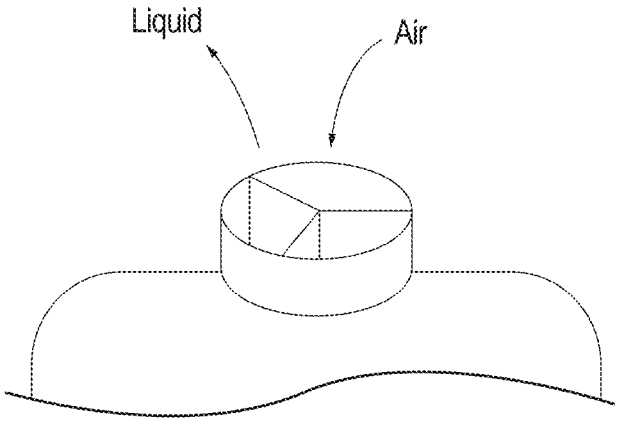
FIG. 15 is a detailed view of one embodiment of FIG. 13 that incorporates the opening, and an aerator.
Figure 16:
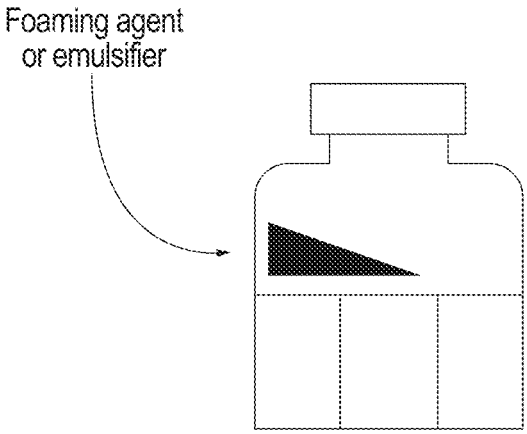
FIG. 16 is a front sectional view of one embodiment of a partial assembly of the liquid housing that incorporates the cap, opening, mixing chamber, liquid chambers, and an emulsifier or foaming agent.

In one embodiment, as shown in FIG. 15, is an alternative detail depicting an ingredient combiner or aerator, and illustrating a juncture at the opening 14 of the container. These features may assist in the mixing of ingredients and/or improve the flavor and/or aroma of the product. In one embodiment, as shown in FIG. 16, is an alternative detail depicting a solid ingredient such as a foaming agent or emulsifier. This may be incorporated to improve the properties of the beverage.

Figure 17:
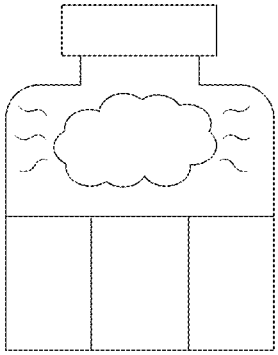
FIG. 17 is a front sectional view of one embodiment of a partial assembly of the liquid housing that incorporates the cap, opening, mixing chamber, liquid chambers, and a gas inside the housing.
Figure 18:
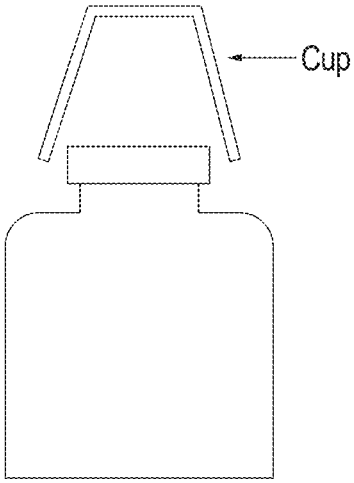
FIG. 18 is a front sectional view of one embodiment of a partial assembly of the liquid housing that incorporates the cap, opening, with a removable cup.
Figure 19:
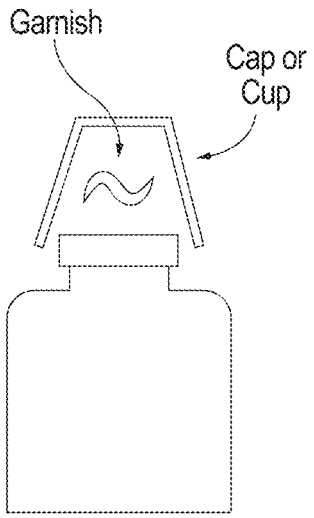
FIG. 19 is a front sectional view of one embodiment of a partial assembly of the liquid housing that incorporates the cap, opening, with a garnish inside the cap.

In one embodiment, as shown in FIG. 17, is an alternative detail depicting an aromatic feature. In one embodiment, as shown in FIG. 18, is an alternative detail depicting a cup attaching to the container. This feature may be convenient in certain scenarios. In one embodiment, as shown in FIG. 19, is an alternative detail where a solid item (such as a garnish) is stored inside the cap.

Figure 20:
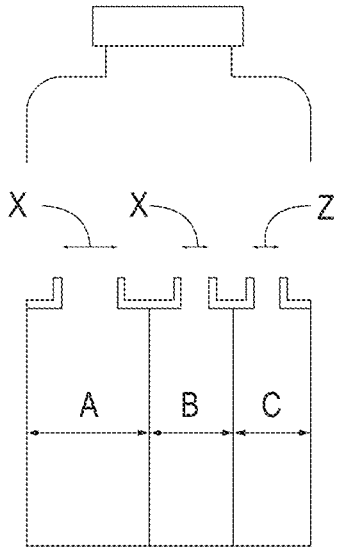
FIG. 20 is a front sectional view of one embodiment of a partial assembly of the liquid housing that incorporates the cap, opening, and liquid chambers of differing sizes.

In one embodiment, as shown in FIG. 20, is an alternative detail which shows proportion of openings to multiple chambers in proportion to the dimensions and/or capacity of said chambers.

Figure 21:
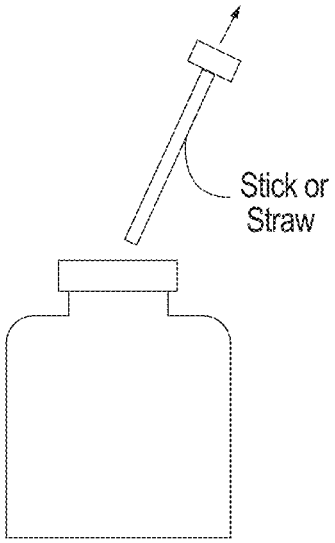
FIG. 21 is a front sectional view of one embodiment of a partial assembly of the liquid housing with the cap being removed with an attached stick or straw, and an opening.

In one embodiment, as shown in FIG. 21, is an alternative detail which shows a stir drinking straw, which may detach from the container. In one embodiment, as shown in FIG. 22, is an alternative detail which shows a tethered cap.

Figure 22:
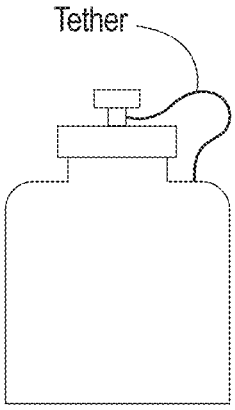
FIG. 22 is a front sectional view of one embodiment of a partial assembly of the liquid housing that incorporates the cap with a tether connecting the cap and the liquid housing.
Figure 23:
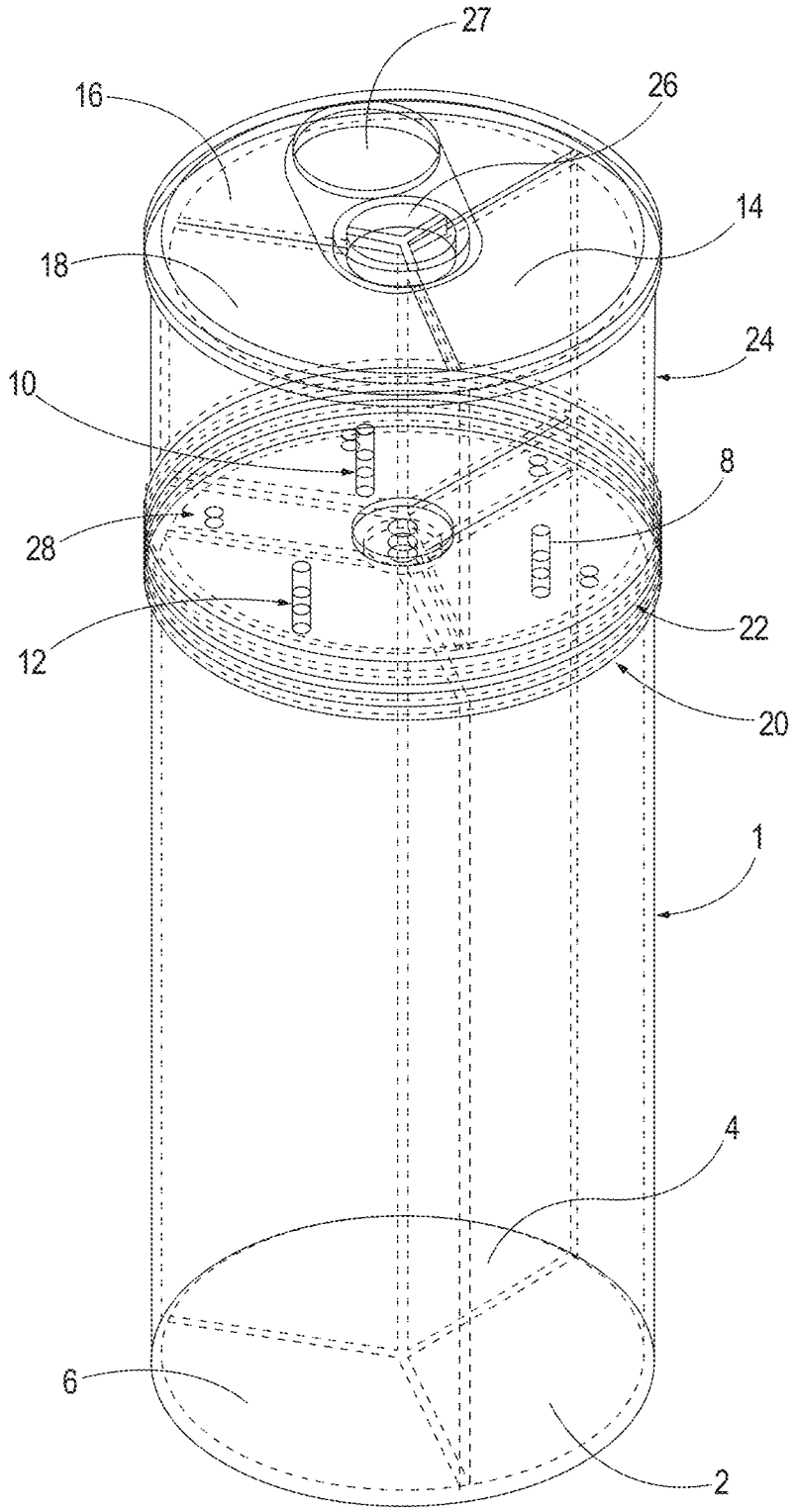
FIG. 23 (PRIOR ART) is a beverage container of prior art reference US20160270600A1

FIG. 22 illustrates an insert 112 that includes the function of the container chambers. In this regard, insert 111 includes liquid chambers 134*a*, 134*b*, and 134*c* that can hold a liquid or other substance, and are separated by partitions 130. A membrane An upper portion or insert 111 may be affixed to closure 16 by a release member 142 such that upon actuation of closure 16, a membrane 140 seals an upper portion of the liquid chambers. FIG. 23 shows insert 111 inserted into the neck of a container 112, which in this position is referred to as a neck insert. Neck insert 111 may be affixed to an internal surface of the neck of the container or connected to the container by any other means.

Figure 24:
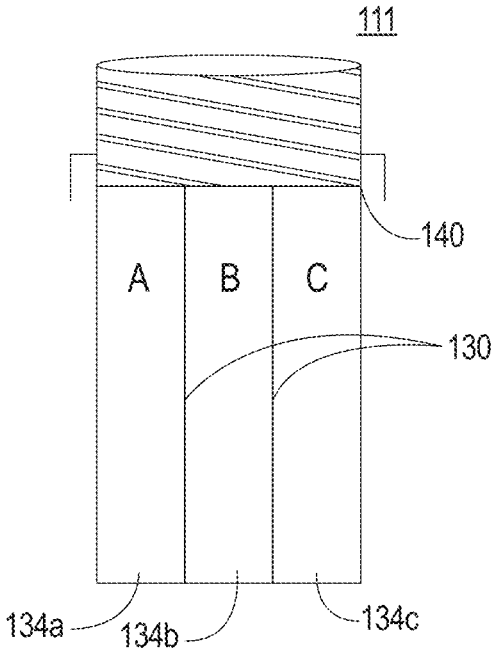
FIG. 24 schematically illustrates a neck insert.
Figure 25:
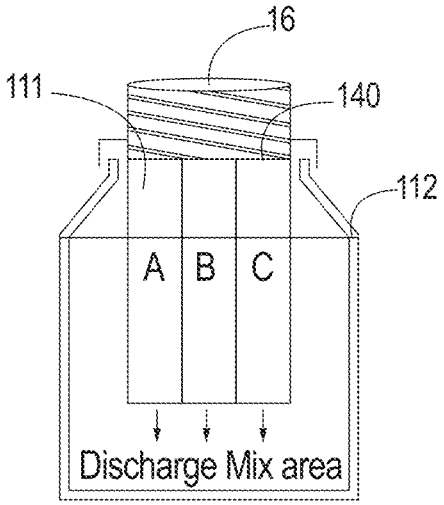
FIG. 25 schematically illustrates the embodiment of the neck insert installed in a beverage container.
Figure 26:
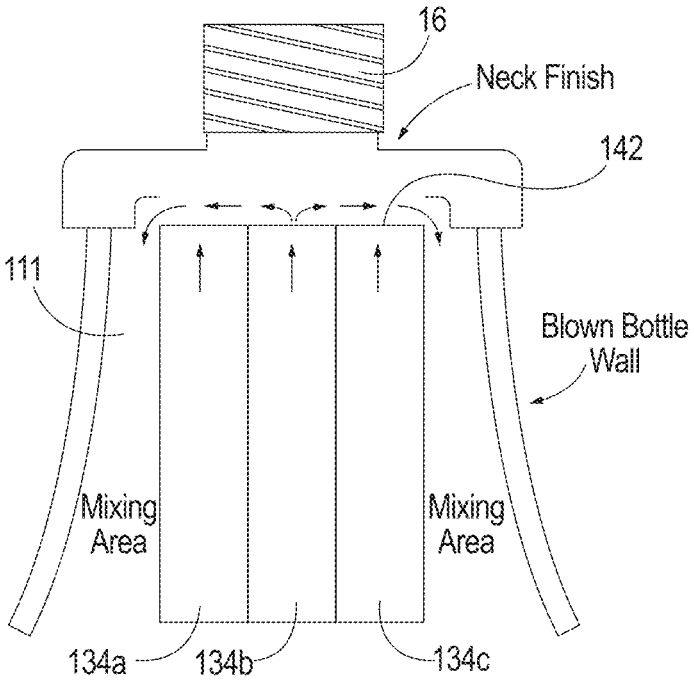
FIG. 26 schematically illustrates a container having a neck insert according to an aspect of the present.

FIG. 24 illustrates the operation of insert 111. As closure 16 is actuated and moved upwardly, membrane 140 is deformed and ruptures, as described above, thereby enabling the liquid within chambers 134*a* to 134*c* to be free to flow from the chambers into the mixing are 120.

Alternatively, A process for manufacturing a partitioned beverage container may comprise extruding one or more internal chambers inside a blow molded shaped exterior chamber. The beverage container may utilize pre-formed, filled and sealed parisons inside a blow molded exterior shape. A container for flowable components adapted to be worn by the user may comprise: At least one concave container exterior surface; Two or more partitions separating the flowable components; A mixing area for admixing the partitioned components; And a frangible closure whereby the frangible closure permits admixing and access to the admixed components.

The present invention is a container with multiple compartments which may allow the mixing and/or dispensation of multi-ingredient beverages. The embodiment as depicted consists of a container which contains multiple ingredient chambers, a mixing chamber, an opening, and a cap in the configuration as shown. However, there are numerous methods and configurations that allow for this kind of action to be performed. These embodiments may allow ingredients to remain separated using different methods, and may allow ingredients to be combined using different methods.

Additionally, these embodiments may display beneficial qualities such as, but not limited to: Ease/effectiveness of ingredient combination by user, ease of dispensation by user, Ease/economy of manufacture, visual appeal, visual communication of product benefits and/or functionality, usability, adaptability to ingredient variety, ease/economy of ingredient insertion by beverage manufacturer, durability, resistance to changes in temperature, air pressure, humidity, and other environmental variables, mechanical reliability, material stability and consistency, ergonomics, ease of shipping and transport, recyclability, portability, and other aspects which may enhance the appeal and/or functionality of the product.

There are alternative details which may be applied to any referenced embodiments. These alternative details may enhance qualities such as, but not limited to: Ease/effectiveness of ingredient combination by user, ease of dispensation by user, Ease/economy of manufacture, visual appeal, visual communication of product benefits and/or functionality, usability, adaptability to ingredient variety, ease/economy of ingredient insertion by beverage manufacturer, durability, resistance to changes in temperature, air pressure, humidity, and other environmental variables, mechanical reliability, material stability and consistency, ergonomics, ease of shipping and transport, recyclability, portability, and other aspects which may enhance the appeal and/or functionality of the product.

While various embodiments of the present disclosure have been described above, it should be understood that they have been presented by way of example only, and not of limitation. Likewise, the various diagrams may depict an example architectural or other configuration for the invention, which is provided to aid in understanding the features and functionality that can be included in the invention. The invention is not restricted to the illustrated example architectures or configurations, but the desired features can be implemented using a variety of alternative architectures and configurations.

Indeed, it will be apparent to one of skill in the art how alternative functional configurations can be implemented to implement the desired features of the present disclosure. Additionally, with regard to flow diagrams, operational descriptions and method claims, the order in which the steps are presented herein shall not mandate that various embodiments be implemented to perform the recited functionality in the same order unless the context dictates otherwise.

Although the disclosure is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the disclosure, whether or not such embodiments are described and whether or not such features are presented as being a part of a described embodiment. Thus, the breadth and scope of the present invention should not be limited by any of the above-described exemplary embodiments.

Maintaining separate beverage components in individual chambers located within the admixing chamber formed by the exterior of the package (FIG. 9) may allow a higher degree of protection of the ingredients from degradation, and protect against rupture due to external package impact. Additionally, other ingredients may be stored in the admixing chamber to add different benefits to the beverage. These may include aeration or other gas evolving components, garnishes, flavorings, particulates, pH modifiers, and other non-limiting ingredients of import to those of skill in the art.

An example of a shelf stable beverage where separated ingredients would provide a substantially fresher drinking experience in a beverage product is one that could not be formulated without the benefit of separating the ingredients in individual chambers. Some ingredients that would be preferred could compromise the shelf life of the overall beverage composition, therefore limiting their incorporation in shelf stable beverages providing a freshly made drinking experience.

The following non-limiting example illustrates a beverage formulation that closely provides a user experience most similar to a freshly formulated drink.

Example 1

Beverage components including alcohol containing materials and flavoring materials are provided in the individual beverage component chambers of the container. An egg white powder is provided in the admixing chamber to facilitate mouth feel and a degree of foaming in the composite beverage. The user is instructed to break the separating member and shake the container to allow sufficient mixing of the component ingredients with the egg white. Formation of a beverage most closely representative of a freshly made cocktail is possible via the aforementioned package separation technology. Since egg white is inherently unstable in a premixed beverage without the incorporation of other ingredients to stabilize, emulsify, and prevent microbiological growth, a formulation that incorporates the ingredient without the packaging separation technology described would be prone to failure, or minimal shelf life without the incorporation of refrigeration.

One benefit of maintaining separate individual beverage components, and combining the separated ingredients directly prior to the consumption of the beverage includes the retention of the various aromatic components in the headspace and the retention of flavor compounds in the individual components that would not be found in a beverage having mixed components during extended storage and shelf life.

In tequila as an example, higher alcohols and methanol are produced in greater amounts than other volatile compounds like esters, aldehydes, ketones, carbonyls, acids, furans, and terpenes. More than 150 compounds have been found in tequila, and together they give tequila its characteristic aroma (Benn and Peppard. 1996)

Figure 27:
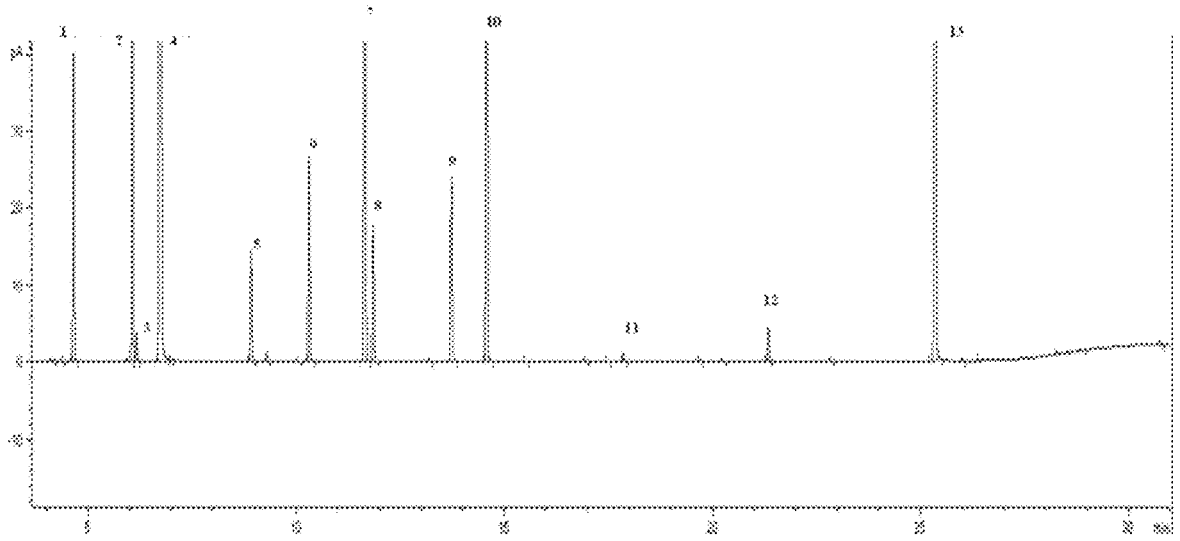
FIG. 27 is gas chromatogram data of the volatile compounds in a fermented agave juice.

FIG. 27 represents some non-limiting compounds responsible for reducing the perceived organoleptic quality of spirits. The values given in the table represent the quotient of the peak surface area of a compound from a sample with a low quality to the peak surface area of this compound from a high quality sample, in which this area was the largest. The fragment ions masses used during peak integrations are given in brackets.

The mixture of aromatic and taste compounds also has a direct impact on the perceived quality of the combined product. Storage of the beverage in a pre-mixed format facilitates the production of negatively perceived taste and aroma compounds that would not be produced if the beverage components were isolated and separate until the point of use. More specifically, a number of "off flavors" and malodourous compounds that contribute to the negative quality perception have been identified. Acetals and esters, as well as dimethyl trisulphide and geosmin(2β,6α-dimethylbicyclo[4.4.0]decan-1β-ol) are known to contribute to negative quality perception. The volatile fraction of the raw spirits with a low quality sensory rating also includes aldehydes, terpenes, thiophene, furan or guaiacol derivatives, xylenes as well as other non-limiting examples. Chemically, the evolution of negative quality compounds through the pre-mixing and storage of beverages is well documented in the art.

Conversely, the quality of non-alcohol containing portions of the composite beverage may be impacted by the production of off flavors and malodourous compounds, as a result of incorporating an alcohol containing portion for the duration of the shelf life. This may decrease anticipated perceived quality over the shelf life, and upon consumption. The degradative effect of pre-mixing the composite beverage may also require the addition of higher levels of additives to offset the production of negative compounds impacting quality.

One benefit of separated ready to drink beverages is the ability to accurately control the quantity of beverage contents consumed. This aspect may be important to those who are restricting calories consumed for dietary or weight control reasons, if the beverage contains some high calorie beverage components.

TABLE II

| Preference Testing | | |
|---|---|---|
| (n30) | Sample A | Sample B |
| Perceived Quality | 90 | 10 |
| Perceived Freshness | 80 | 20 |
| Perceived Value | 90 | 10 |
| Perceived Convenience | 20 | 80 |

Perception of quality and freshness is an important factor in providing a portable ready to drink beverage product. Table II Preference testing data (n30) shows high consumer preference values of freshly prepared beverages when comparing to pre-mixed formulations. Sample A is a fresh beverage prepared in front of the consumer. Sample B is a pre-mixed ready to drink beverage of the same formulation that does not utilize the beverage component separation technology of this invention. Logically, the more closely representative a shelf stable product can approximate a freshly made beverage, the more highly acceptable it is to the consumer. This is not only true of the formulation itself, and visual cues of the separation of ingredients, but also the user experience process a complete must complete in preparing the beverage for consumption. It is also clear from this data that the convenience of a freshly prepared beverage is substantially lower than that of a ready to drink formulation, indicating a tension between freshness and consumer convenience that this product aims to solve, through the use of beverage chamber separation technology in conjunction with formulation and other described consumer valued attributes.

We claim:

1. A flavor system package for maintaining the flavor profile of beverage constituents during shelf life in a consumable beverage product, comprising:

a beverage container having a threaded finish and a sidewall adapted for holding the beverage product;

plural chambers defined in the beverage container, the plural chambers comprising storage chambers; each one the storage chambers having a constituent that is isolated from constituents in other ones of the storage chambers;

a closure having threads adapted for engaging the container threaded finish for sealing the beverage container; and a flexible barrier coupled to the closure and adapted for promoting isolation of the constituents within the container from an exterior of the container, wherein deformation of the flexible barrier upon actuation of the closure unseals the chambers allowing admixing of the constituents.

2. The flavor system package of claim 1 wherein the flexible barrier is frangible, and the closure is coupled to the flexible barrier such that the flexible barrier is breached upon movement of the closure relative to the beverage container.

3. The flavor system of claim 2 wherein the flexible barrier is a membrane.

4. The flavor system package of claim 2 wherein the frangible barrier is breached upon upward movement of the closure relative to the beverage container.

5. The flavor system package of claim 1 wherein the plural chambers are defined by partitions located in the beverage container.

6. The flavor system package of claim 5 wherein at least one of the constituents is an alcoholic beverage and other ones of the constituents are at least one of another alcoholic beverage and a mixer.

7. The flavor system package of claim 1 wherein the isolation of the constituents in chambers is such that an alcohol by volume content of the constituents is maintained.

8. The flavor system package of claim 1 wherein the plural chambers are at least three chambers.

9. The flavor system package of claim 1 wherein the container one is of an extruded plastic container, a stretch blow molded plastic container, and an extrusion blow molded plastic container.

10. A method for maintaining the alcohol by volume content of an alcoholic beverage, comprising the steps of:

in a container of claim 1, actuating the closure, thereby releasing a seal about the storage chambers.

11. The method of claim 10, further comprising the step of enabling the constituents to mix in the chambers.

12. The method of claim 11 wherein the step of enabling the constituents to mix is visible through the container.

13. The flavor system package of claim 1 wherein one of the chambers is formed in the center of beverage container and spaced apart from the sidewall of the beverage container.

14. The flavor system package of claim 1 wherein deformation of the flexible barrier occurs only upon actuation of the closure.

15. The flavor system package of claim 1 wherein the flexible barrier is frangible or moveable.

* * * * *